US008083096B2

(12) United States Patent
Ichiyama et al.

(10) Patent No.: US 8,083,096 B2
(45) Date of Patent: Dec. 27, 2011

(54) AUTOMATIC SUPPLY APPARATUS AND AUTOMATIC SUPPLY METHOD

(75) Inventors: Hiroshi Ichiyama, Nishitama-gun (JP); Kiminobu Numata, Nishitama-gun (JP); Hiroshi Kimura, Nishitama-gun (JP)

(73) Assignee: Olympus Medical Systems Corp., Tokyo (JP)

( * ) Notice: Subject to any disclaimer, the term of this patent is extended or adjusted under 35 U.S.C. 154(b) by 270 days.

(21) Appl. No.: 12/200,494

(22) Filed: Aug. 28, 2008

(65) Prior Publication Data

US 2009/0057327 A1 Mar. 5, 2009

(30) Foreign Application Priority Data

Aug. 30, 2007 (JP) ..... 2007224134

(51) Int. Cl.
*B65G 47/14* (2006.01)
*B65G 59/00* (2006.01)
*G07F 11/00* (2006.01)

(52) U.S. Cl. ..... 221/1; 221/210; 198/348; 198/361; 198/363; 198/367; 198/597; 198/598; 414/618; 414/626; 414/816

(58) Field of Classification Search ..... 221/1, 210; 198/348, 361, 363, 367, 597; 414/618, 626, 414/816

See application file for complete search history.

(56) References Cited

U.S. PATENT DOCUMENTS

2006/0086777 A1 * 4/2006 Itoh et al. ..... 228/253
2006/0111222 A1 * 5/2006 Yasui ..... 483/1
2009/0057327 A1 * 3/2009 Ichiyama et al. ..... 221/1

FOREIGN PATENT DOCUMENTS

JP 7-291435 11/1995
JP 07291435 A * 11/1995
JP 2009057128 A * 3/2009

* cited by examiner

*Primary Examiner* — Gene O. Crawford
*Assistant Examiner* — Rakesh Kumar
(74) *Attorney, Agent, or Firm* — Scully, Scott, Murphy & Presser, P.C.

(57) ABSTRACT

An automatic supply apparatus for an elongate supply target member having elasticity and including both end portions includes a stock mechanism wherein a plurality of supply target members are stocked such that the plurality of supply target members are suspended in an inverted U shape and top portions of the plurality of supply target members are arranged side by side in a row direction, and an extraction mechanism to operate the top portions of the supply target members to extract one supply target member from the plurality of supply target members stocked in the stock mechanism.

4 Claims, 20 Drawing Sheets

AUTOMATIC SUPPLY APPARATUS AND AUTOMATIC SUPPLY METHOD

CROSS-REFERENCE TO RELATED APPLICATIONS

This application is based upon and claims the benefit of priority from prior Japanese Patent Application No. 2007-224134, filed Aug. 30, 2007, the entire contents of which are incorporated herein by reference.

BACKGROUND OF THE INVENTION

1. Field of the Invention

The present invention relates to an automatic supply apparatus and an automatic supply method for extracting one supply target member from a plurality of supply target members and supplying the one supply target member.

2. Description of the Related Art

There have been used various automatic supply devices for extracting one supply target member from a plurality of supply target members and supplying the one supply target member.

Jpn. Pat. Appln. KOKAI Publication No. 7-291435 has disclosed a disposal facility for core members of a circular belt. In this disposal facility, by a single-supply apparatus, one core member is picked up from a plurality of core members hanged on hangers and arranged side by side and is delivered to a hook, and the hook are fed by a belt feed and the core member is conveyed to the following step.

Also used is an automatic supply apparatus for rigid rod members. Referring to FIGS. 20A to 20D, the automatic supply apparatus includes a tray 81 with a longitudinal direction and a width direction. An extraction groove 82 extends in the longitudinal direction at one side end portion with respect to the width direction in the upper surface of the bottom wall of the tray 81. The length and width of the extraction groove 82 are about the same as the length and width of a rod member 84. Further, a wall 83 at one side end portion of the tray 81 is openable and closeable. Referring to FIG. 20A, in this automatic supply apparatus, a plurality of rod members 84 are placed flat and arranged side by side in the width direction of the tray 81 and so stocked, on the upper surface of the bottom wall of the tray 81. Referring to FIG. 20B, as indicated by an arrow S1 therein, when the tray 81 is rotated and the extraction groove 82 side of the tray 81 is moved downward, the plurality of rod members 84 are moved toward the extraction groove 82, and the rod member 84 at one end side portion is guided into the extraction groove 82 and the whole one rod member 84 is contained in the extraction groove 82. Referring to FIG. 20C, as indicated by an arrow S2 therein, when the tray 81 is rotated and the extraction groove 82 side of the tray 81 is moved upward, the rod members 84 other than the rod member 84 contained in the extraction groove 82 are moved from the extraction groove 82 side to the opposite side, and the one rod member 84 is separated from the other rod members 84. Further, referring to FIG. 20D, as indicated by an arrow O therein, the wall 83 at the one side end portion of the tray 81 is opened, and so the rod member 84 contained in the extraction groove 82 is released to the outside of the tray 81 as indicated by an arrow D in FIG. 20D. Thus, the one rod member 84 is extracted.

BRIEF SUMMARY OF THE INVENTION

In an aspect of the present invention, an automatic supply apparatus for an elongate supply target member having elasticity and including both end portions includes: a stock mechanism wherein a plurality of supply target members are stocked such that the plurality of supply target members are suspended in an inverted U shape and top portions of the plurality of supply target members are arranged side by side in a row direction; and an extraction mechanism to operate the top portions of the supply target members to extract one supply target member from the plurality of supply target members stocked in the stock mechanism.

In another aspect of the present invention, an automatic supply method for an elongate supply target member having elasticity and including both end portions includes: stocking a plurality of supply target members by suspending the plurality of supply target members in an inverted U shape and arranging top portions of the plurality of supply target members side by side in a row direction; and extracting one supply target member from the plurality of stocked supply target members by operating the top portions of the supply target members.

BRIEF DESCRIPTION OF THE SEVERAL VIEWS OF THE DRAWING

The accompanying drawings, which are incorporated in and constitute a portion of the specification, illustrate embodiments of the invention, and together with the general description given above and the detailed description of the embodiments given below, serve to explain the principles of the invention.

DETAILED DESCRIPTION OF THE INVENTION

One embodiment of the present invention will hereinafter be described with reference to the drawings.

FIGS. 1 to 19 show one embodiment of the present invention.

A coil supply apparatus as an automatic supply apparatus is explained with reference to FIGS. 1 to 5.

A supply target member of the coil supply apparatus is a coil 22.

The coil 22 is a long member including both end portions, is relatively highly elastically repulsive, and is used as, for example, a coil sheath of a biopsy forceps.

Figure 1:
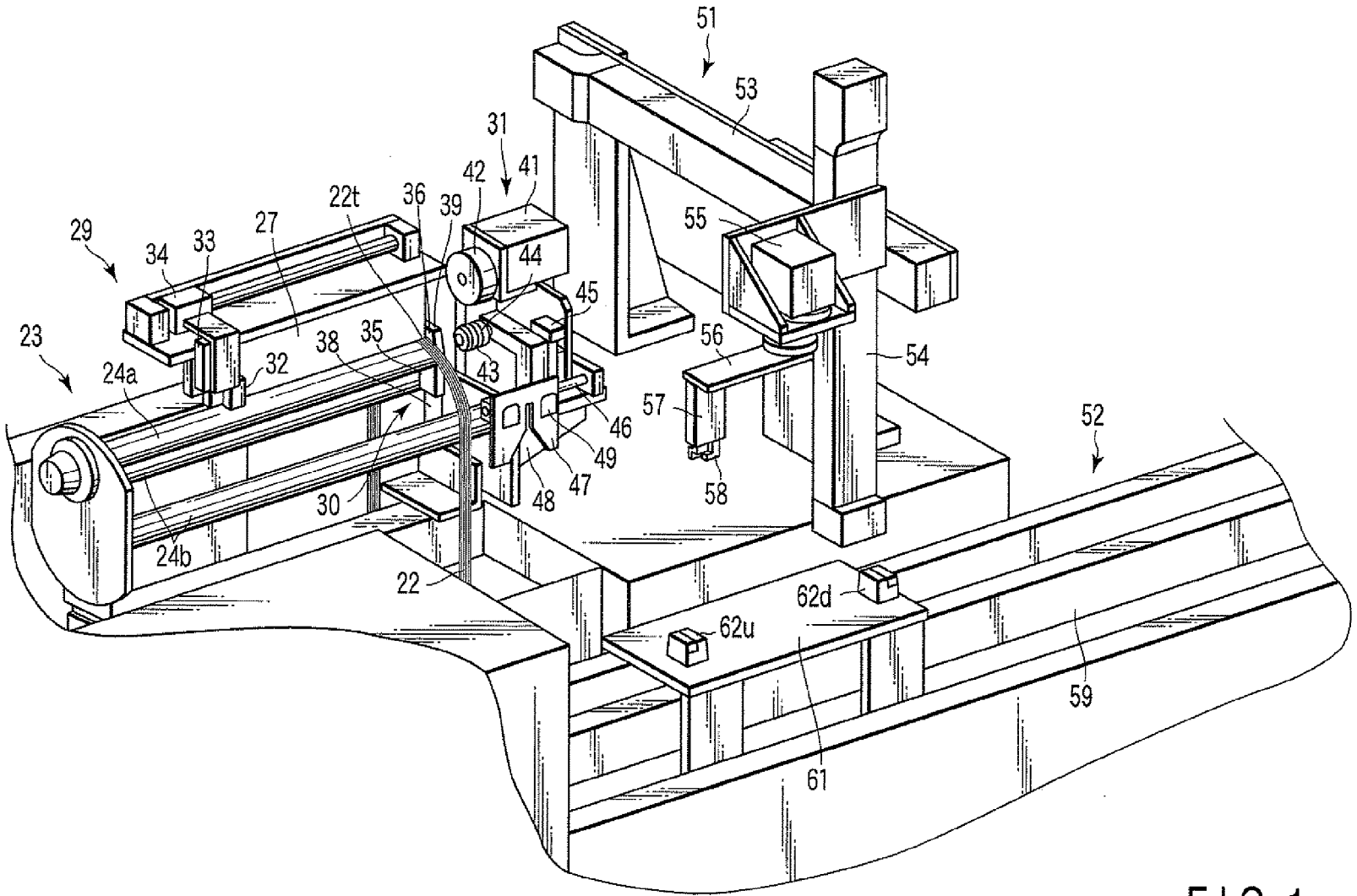
FIG. 1 is a perspective view showing a coil supply apparatus in one embodiment of the present invention.

Referring to FIG. 1, the coil supply apparatus includes a stock unit 23 as a stock mechanism to stock a plurality of coils 22. In the stock unit 23, a columnar stick-shaped suspension bar 24*a* and a pair of auxiliary suspension bars 24*b* as a suspension portion extend substantially horizontally and the coil 22 is to be suspended in an inverted U shape on the suspension bars 24*a* and 24*b*. The pair of auxiliary suspension bars 24*b* is disposed at about the same height, and the suspension bar 24*a* is disposed above the middle portion between the pair of auxiliary suspension bars 24*b*. Owing to such an arrangement, the top portion of the coil 22 suspended in an inverted U shape has a relatively large radius of curvature.

Figure 2:
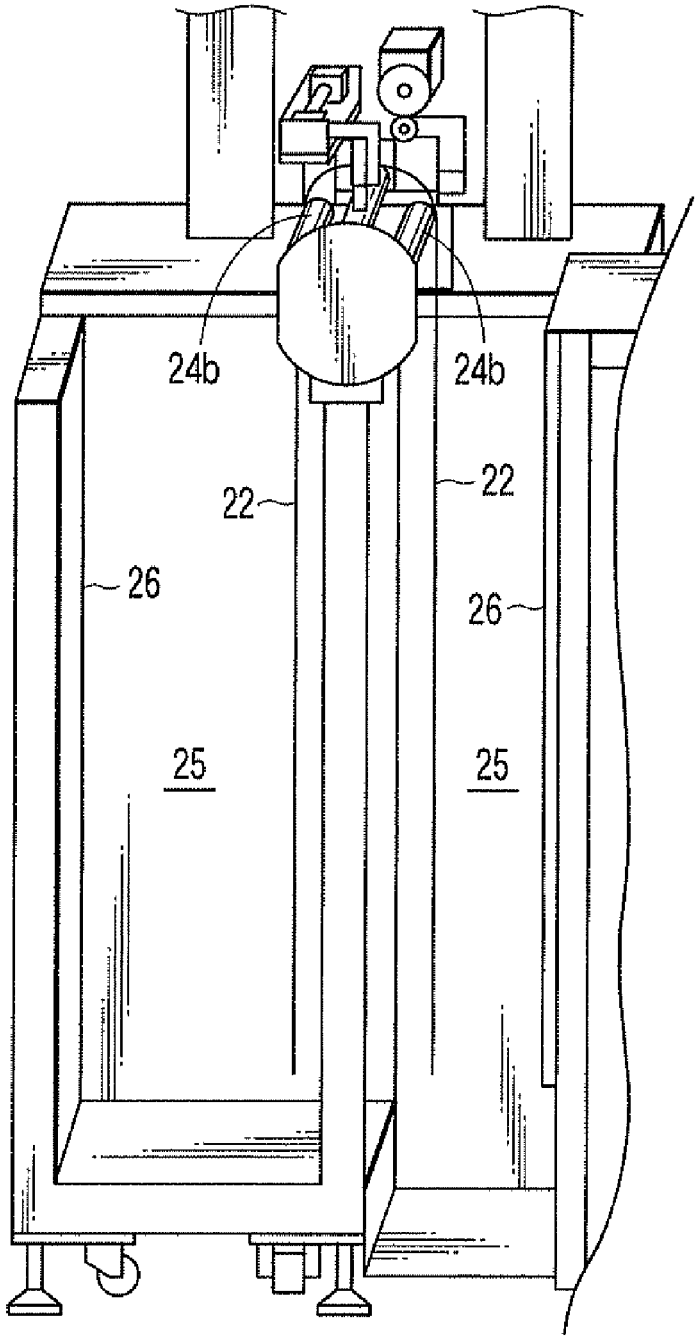
FIG. 2 is a perspective view showing a stock unit in one embodiment of the present invention.

Referring to FIG. 2, a pair of storage spaces 25 is formed under the pair of auxiliary suspension bars 24*b* and both end side portions of the suspended coil 22 are stored in the storage spaces 25, respectively. The respective storage spaces 25 are surrounded by boxes 26 to prevent both end side portions of the coil 22 from coming out of the apparatus.

Figure 3:
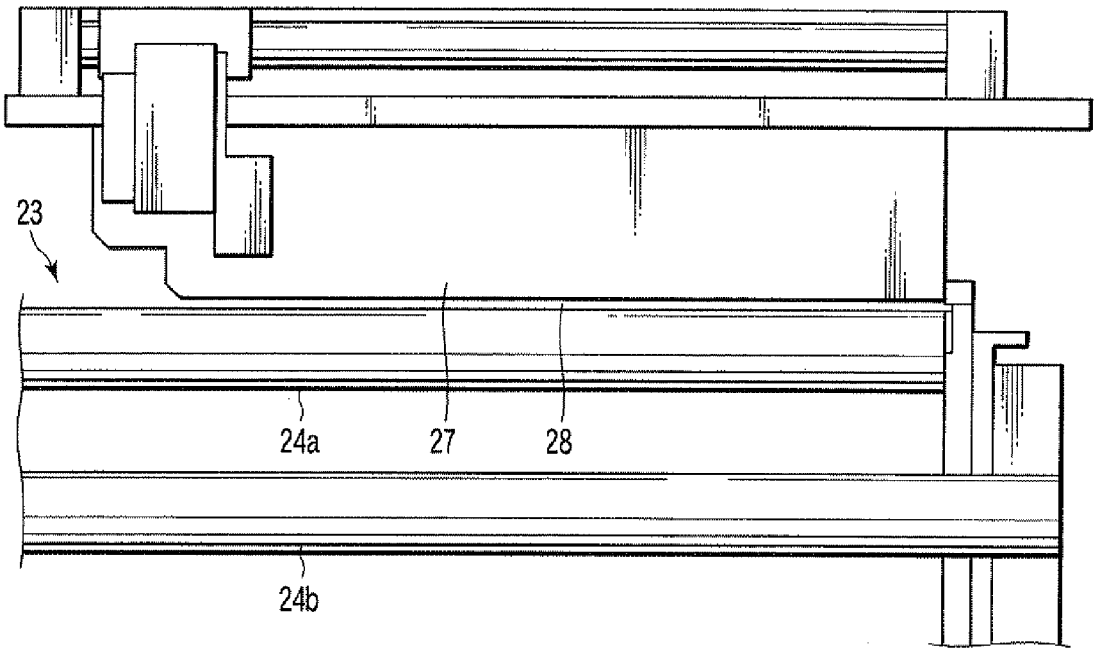
FIG. 3 is a front view showing the stock unit in one embodiment of the present invention.

Referring to FIG. 3, a row plate 27 as a row portion is disposed over the suspension bar 24*a*. The row plate 27 is disposed along a vertical plane, and extends along the suspension bar 24*a*. A row space 28 is formed between the upper end portion of the suspension bar 24*a* and the lower end face of the row plate 27 and coil top portions 22*t* are to be arranged side by side in the row space 28. The row space 28 extends along the suspension bar 24*a* and the row plate 27, and has a width substantially equal to the outside diameter of the coil 22.

Figure 4:
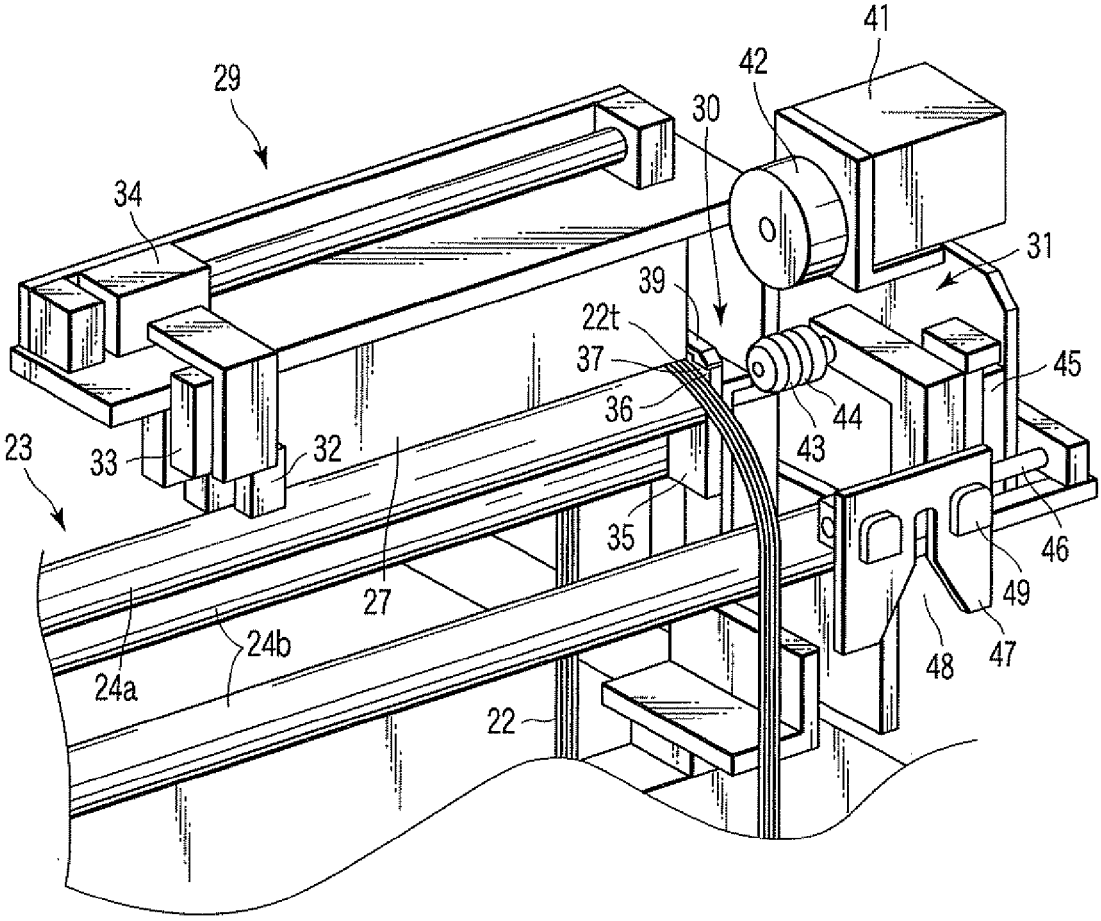
FIG. 4 is a perspective view showing an extraction mechanism in one embodiment of the present invention.

Referring to FIG. 4, the coil supply apparatus includes an extraction mechanism to extract one coil 22 from a plurality of coils 22 stocked in the stock unit 23. In the extraction mechanism, an extrusion unit 29 as a guide unit, an extraction unit 30 and a feed unit 31 are arranged in order from the upstream side to downstream side.

The extrusion unit 29 of the extraction mechanism is to extrude the plurality of coil top portions 22*t* arranged side by side in the row direction and guide one coil top portion 22*t* to the extraction unit 30. In the extrusion unit 29, there is disposed a substantially rectangular-parallelepiped-shaped extrusion portion 32 to extrude the coil top portions 22*t*. The extrusion portion 32 is vertically movable over the suspension bar 24*a* owing to a contact air cylinder 33, and switchable between a state where the extrusion portion 32 is being contact with the upper end portion of the suspension bar 24*a* and a state where the extrusion portion 32 is being separated from the upper end portion of the suspension bar 24*a*. Further, the extrusion portion 32 and the contact air cylinder 33 are integrally movable in the longitudinal direction of the suspension bar 24*a* owing to an extrusion air cylinder 34. That is, the extrusion portion 32 is movable along the suspension bar 24*a* in the states where the extrusion portion 32 is being contact with or separated from the upper end portion of the suspension bar 24*a*.

Figure 5:
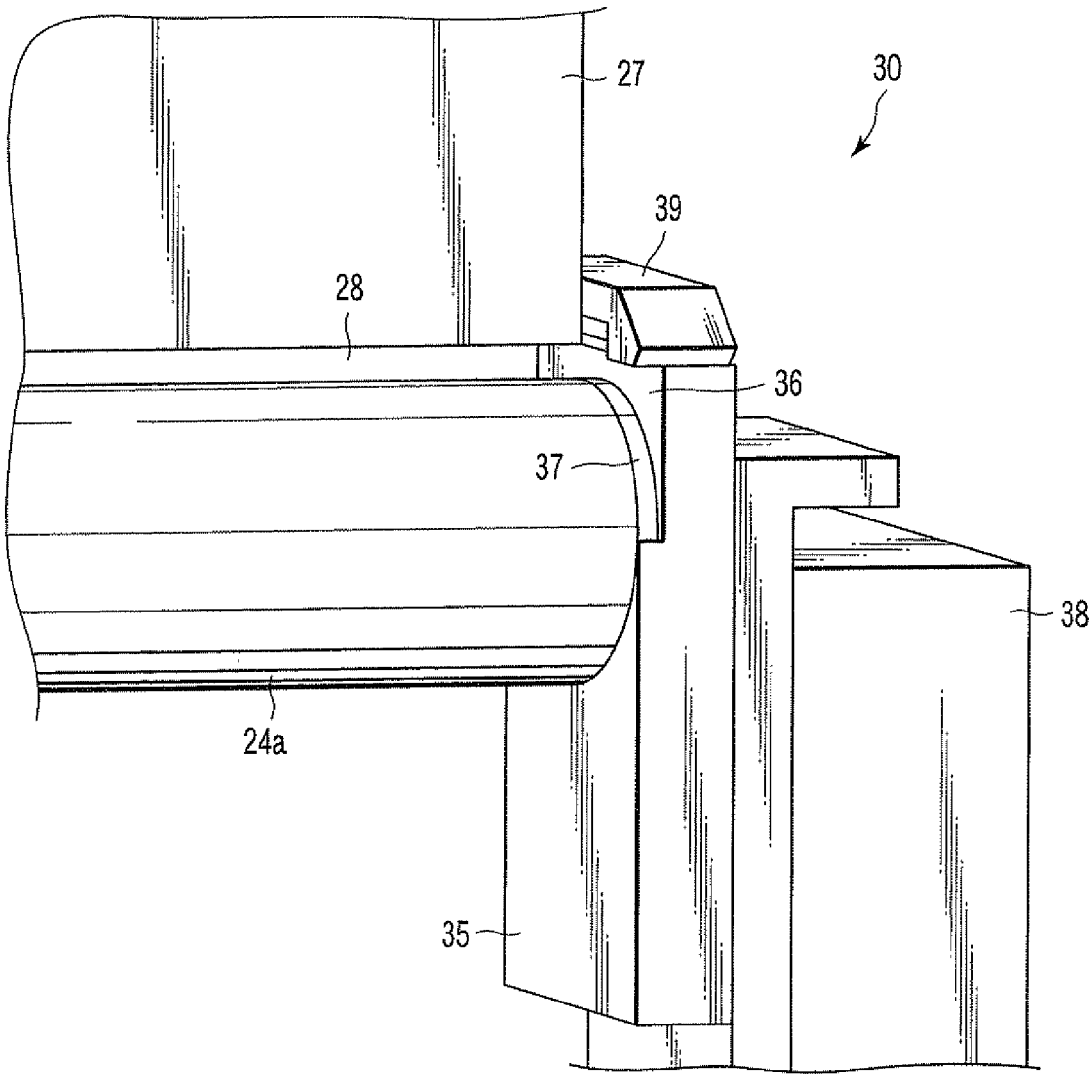
FIG. 5 is a perspective view showing an extraction unit in one embodiment of the present invention.

Referring to FIG. 5, the extraction unit 30 of the extraction mechanism is to extract one coil top portion 22*t* form the plurality of coil top portions 22*t* arranged side by side. In the extraction unit 30, an extraction member 35 in the shape of a thick plate is arranged side by side with the downstream end portion of the suspension bar 24*a*. The downstream end face of the suspension bar 24*a* and the upstream side face of the extraction member 35 are perpendicular to the longitudinal direction of the suspension bar 24*a*, and are coplanar with each other. An extraction groove 36 as a storage portion extends horizontally at the upper end portion of the upstream surface of the extraction member 35. The width of the extraction groove 36 is substantially equal to the outside diameter of the coil 22, and one coil top portion 22*t* can only be stored in the extraction groove 36. The bottom face of the extraction groove 36 forms a peripheral surface substantially in the same shape as the upper peripheral surface of the suspension bar 24*a*, and forms an abutment surface 37 as an abutment portion to abut against the lower side of the coil top portion 22*t*. The extraction member 35 is vertically movable owing to an extraction air cylinder 38, and switchable between a lower storage position and an upper extraction position. When the extraction member 35 is at the storage position, the abutment surface 37 of the extraction groove 36 is substantially coplanar with the upper peripheral surface of the suspension bar 24*a*. The downstream end face of the row plate 27 over the suspension bar 24*a* is substantially coplanar with the upstream side face of the extraction member 35 and when the extraction member 35 is moved upward, only a small clearance is formed between the downstream end face of the row plate 27 and the upstream side face of the extraction member 35. In other words, the downstream end portion of the row plate 27 functions as a stopper portion to stop the upward movement of the coil top portions 22*t* other than the coil top portion 22*t* stored in the extraction groove 36. In addition, a first sensor 39 is disposed at the upper end portion of the extraction member 35 and is to detect the presence of the coil 22 in the extraction groove 36. The first sensor 39 makes it possible to detect whether the coil top portion 22*t* is stored in the extraction groove 36.

Referring again to FIG. 4, the feed unit 31 of the extraction mechanism is to feed the coil 22 including the extracted coil top portion 22*t* in its longitudinal direction, and separates the coil 22 from the other coils 22. In the feed unit 31, there is disposed a feed roller 42 rotated by a rotation motor 41. A clamp roller 43 is disposed under the feed roller 42. In the clamp roller 43, a clamp groove 44 to clamp the coil 22 extends over a circumference of the clamp roller 43. The axial directions of the feed roller 42 and the clamp roller 43 are substantially parallel to each other, and are substantially perpendicular to the extending direction in which the extraction groove 36 of the extraction unit 30 extends. The clamp roller 43 is vertically movable owing to a vertical movement air cylinder 45, and switchable between an upper clamp position where the clamp roller 43 is being contact with the feed roller 42 and a lower non-clamp position where the clamp roller 43 is being separated from the feed roller 42. The feed roller 42, the clamp roller 43 and the vertical movement air cylinder 45 are integrally movable in the axial direction owing to a horizontal movement air cylinder 46, and switchable between a feed position where they are being proximate to the extraction unit 30 and a non-teed position where they are being separated from the extraction unit 30. At the feed position, when the clamp roller 43 is at the clamp position, the clamp groove 44 of the clamp roller 43 is located on the horizontally downstream side of the extraction groove 36 disposed at the extraction position, and when the clamp roller 43 is at the non-clamp position, the extending direction in which the abutment surface 37 of the extraction groove 36 disposed at the extraction position extends to the downstream side is located between the feed roller 42 and the clamp roller 43. Further, a guide plate 47 is disposed under the downstream sides of the feed roller 42 and the clamp roller 43. A guide groove 48 extends in the guide plate 47 and is to guide the downstream side of the coil 22 when the coil 22 is fed to the upstream side. Moreover, a second sensor 49 is disposed in the guide plate 47 and is to detect the presence of the coil 22 in the guide groove 48. The second sensor 49 makes it possible to detect the position of the downstream end portion of the coil 22. In addition, the guide plate 47 is integrally movable together with the feed roller 42, etc., owing to the horizontal movement air cylinder 46. Here, the above-mentioned first sensor 39 of the extraction unit 30 also has a function to detect the position of the upstream end portion of the coil 22 when the coil 22 is fed to the downstream side.

Referring again to FIG. 1, the coil supply apparatus includes a conveyance mechanism to convey the coil 22 extracted by the extraction mechanism to the following step. In the conveyance mechanism, a handover unit 51 and a conveyer unit 52 are arranged in order from the upstream side to the downstream side.

In the handover unit 51 of the conveyance mechanism, a horizontal conveyance air cylinder 53 is disposed. Owing to the horizontal conveyance air cylinder 53, a vertical conveyance air cylinder 54 is movable in a horizontal direction parallel to the feeding direction of the feed unit 31. Owing to the vertical conveyance air cylinder 54, a reversing motor 55 is vertically movable. The proximal end portion of a reversing arm 56 is coupled to the reversing motor 55, and the reversing arm 56 can be reversed by the reversing motor 55. That is, the reversing arm 56 is switchable between two directions perpendicular to the feeding direction of the feed unit 31, i.e., a normal direction in which the terminal end portion of the reversing arm 56 faces the feed unit 31 and a opposite direction opposite to the normal direction, by moving in an area on the side separate from the feed unit 31. A chuck air cylinder 57 is coupled to the distal end portion of the reversing arm 56 and extends downward, and a chuck 58 is coupled to the lower end portion of the chuck air cylinder. The chuck 58 is openable and closeable by the chuck air cylinder 57, and the open and close direction of the chuck 58 substantially coincides with the longitudinal direction of the reversing arm 56. Then, when the vertical conveyance air cylinder 54 is disposed in closest proximity to the feed unit 31 by the horizontal conveyance air cylinder 53, the reversing motor 55 is disposed highest by the vertical conveyance air cylinder 54 and the reversing arm 56 is disposed in the normal direction by the reversing motor 55, the chuck 58 is disposed at a grip position in the vicinity of the downstream sides of the feed roller 42 and the clamp roller 43. Moreover, when the vertical conveyance air cylinder 54 is disposed in closest proximity to the conveyer unit 52 by the horizontal conveyance air cylinder 53, the reversing motor 55 is disposed lowest by the vertical conveyance air cylinder 54 and the reversing arm 56 is disposed in the normal direction or the opposite direction by the reversing motor 55, the chuck 58 is disposed at an upstream handover position or a downstream handover position described later.

In the conveyer unit 52 of the conveyance mechanism, a conveyer 59 extends perpendicularly to the feeding direction of the feed unit 31, that is, in a direction parallel to the reversing arm 56 disposed in the normal direction or the opposite direction. The conveyer 59 is equipped with a pallet 61 to be conveyed by the conveyer 59. Moreover, the conveyer 59 is provided with a stopper to stop the movement of the pallet 61, and a positioning pin to position the pallet 61 at an uppermost stream handover position. The stopper and the positioning pin are driven by a stopper air cylinder and a positioning air cylinder, respectively. On the upper surface of the pallet 61, there are provided an upstream clamp **62*u* and a downstream clamp 62*d* on the upstream side and the downstream side to hold the upstream end portion and the downstream end portion of the coil 22, respectively. The upstream clamp 62*u* and the downstream clamp 62*d* are openable and closable by an upstream clamp air cylinder and a downstream clamp air cylinder respectively, and the longitudinal direction of the conveyer 59 substantially coincides with the open and close directions of the upstream clamp 62*u* and the downstream clamp 62*d*. With respect to the width direction of the conveyer 59, the positions in the vicinity of the upstream clamp 62*u* and the downstream clamp 62*d* and opposite to the feed unit 31 are the above-mentioned upstream handover position and downstream handover position of the chuck 58 of the handover unit 51**.

A coil supply method as an automatic supply method is explained with reference to FIGS. 6 to 19.

Figure 6:
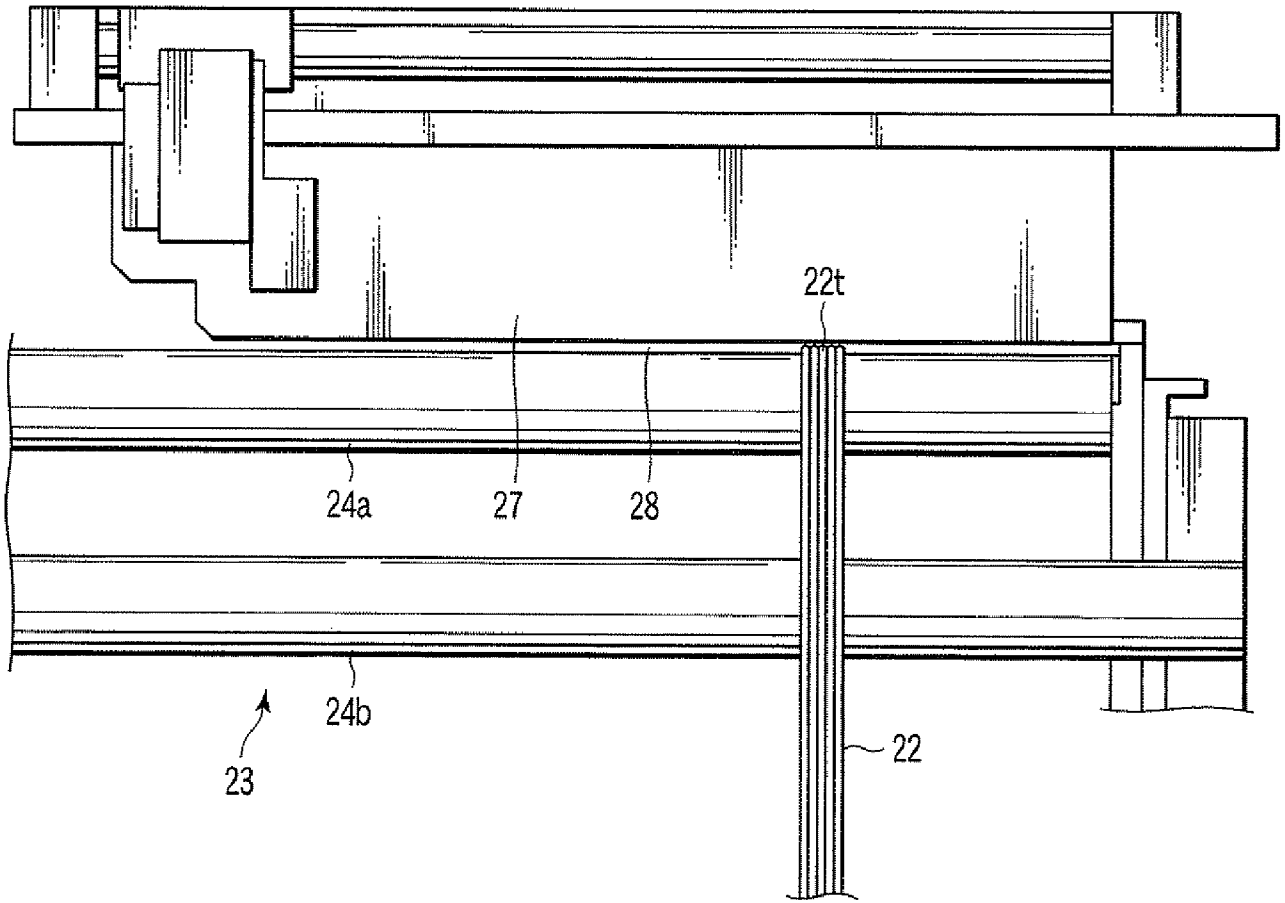
FIG. 6 is a front view showing a stock step of a coil supply method in one embodiment of the present invention.

Referring to FIG. 6, the extrusion portion 32 is disposed at a position which is an uppermost stream position and where the extrusion portion 32 is being separated from the upper end portion of the suspension bar **24*a*, by the contact air cylinder 33 and the extrusion air cylinder 34. An operator suspends a plurality of coils 22 on the suspension bar 24*a* and the pair of auxiliary suspension bars 24*b* in an inverted U shape, and sequentially extrudes the plurality of coil top portions 22*t* into the row space 28 between the suspension bar 24*a* and the row plate 27. As a result, the coil top portions 22*t* are arranged side by side without being intertwined with each other. Thus, the plurality of coils 22** are stocked.

Figure 7:
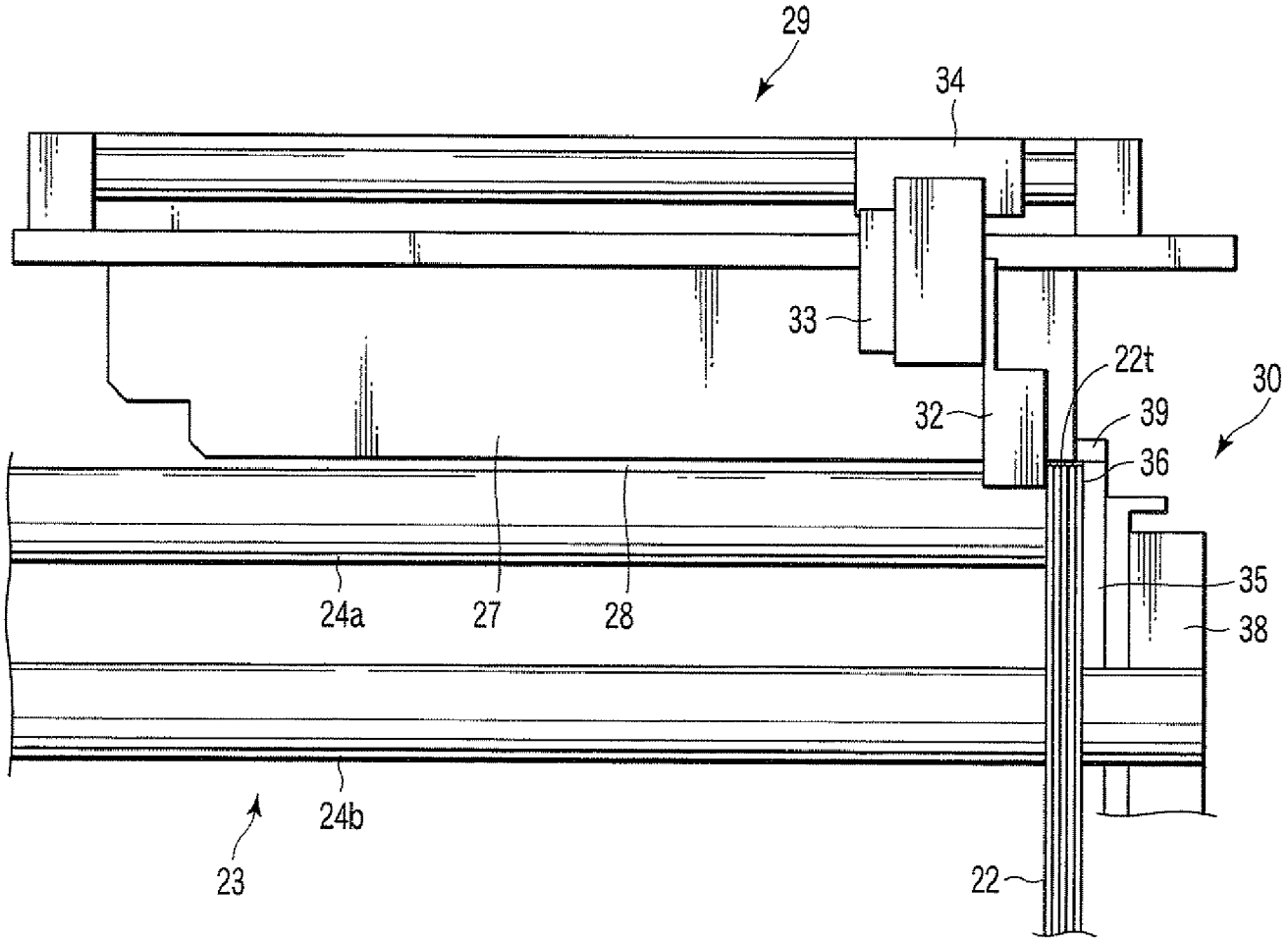
FIG. 7 is a front view showing an extrusion step in one embodiment of the present invention.

Referring to FIG. 7, the extrusion portion 32 is brought into contact with the upper end portion of the suspension bar **24*a* and is moved along the suspension bar 24*a* from the upstream side to the downstream side, by the contact air cylinder 33 and the extrusion air cylinder 34. By the extrusion portion 32, all of the coil top portions 22*t* arranged side by side are pushed toward the downstream side without being intertwined with each other, and the downmost stream coil top portion 22*t* is guided to the extraction groove 36**.

Figure 8:
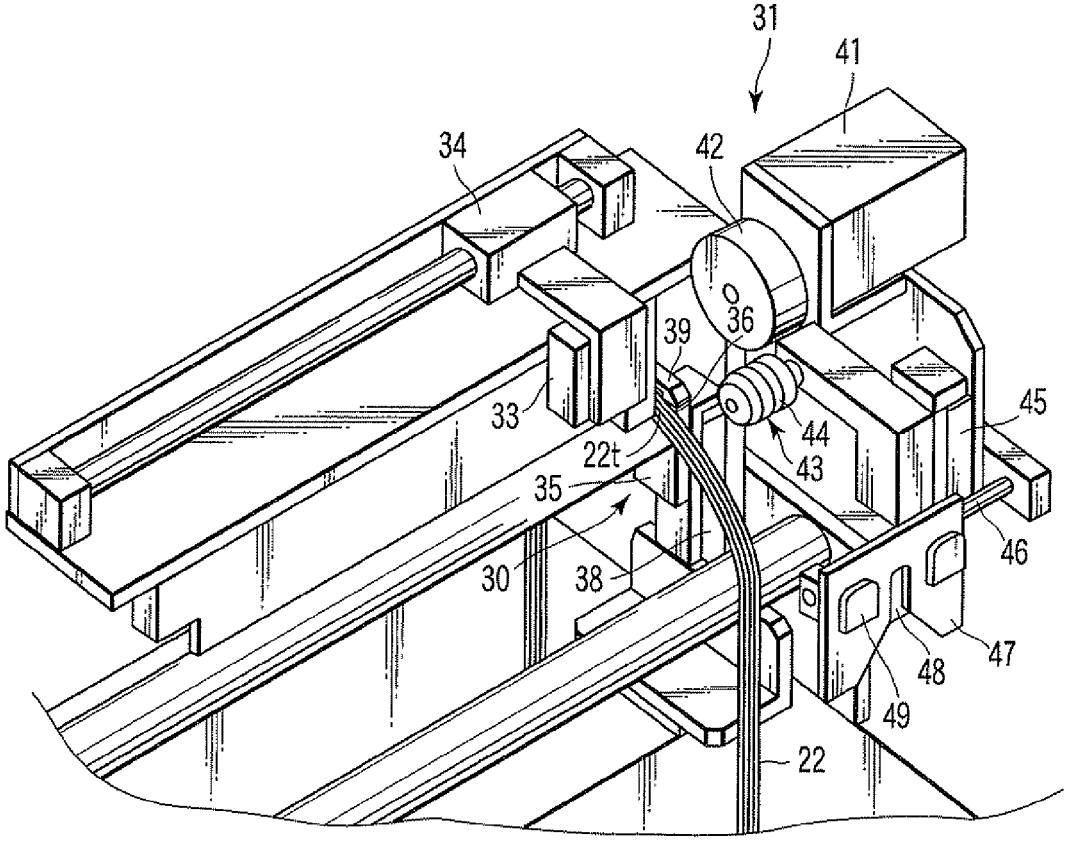
FIG. 8 is a perspective view showing a storage step in one embodiment of the present invention.

Referring to FIG. 8, the downmost stream coil top portion **22*t* alone is contained in the extraction groove 36. The first sensor 39 detects that the coil top portion 22*t* has been contained in the extraction groove 36**.

Figure 9:
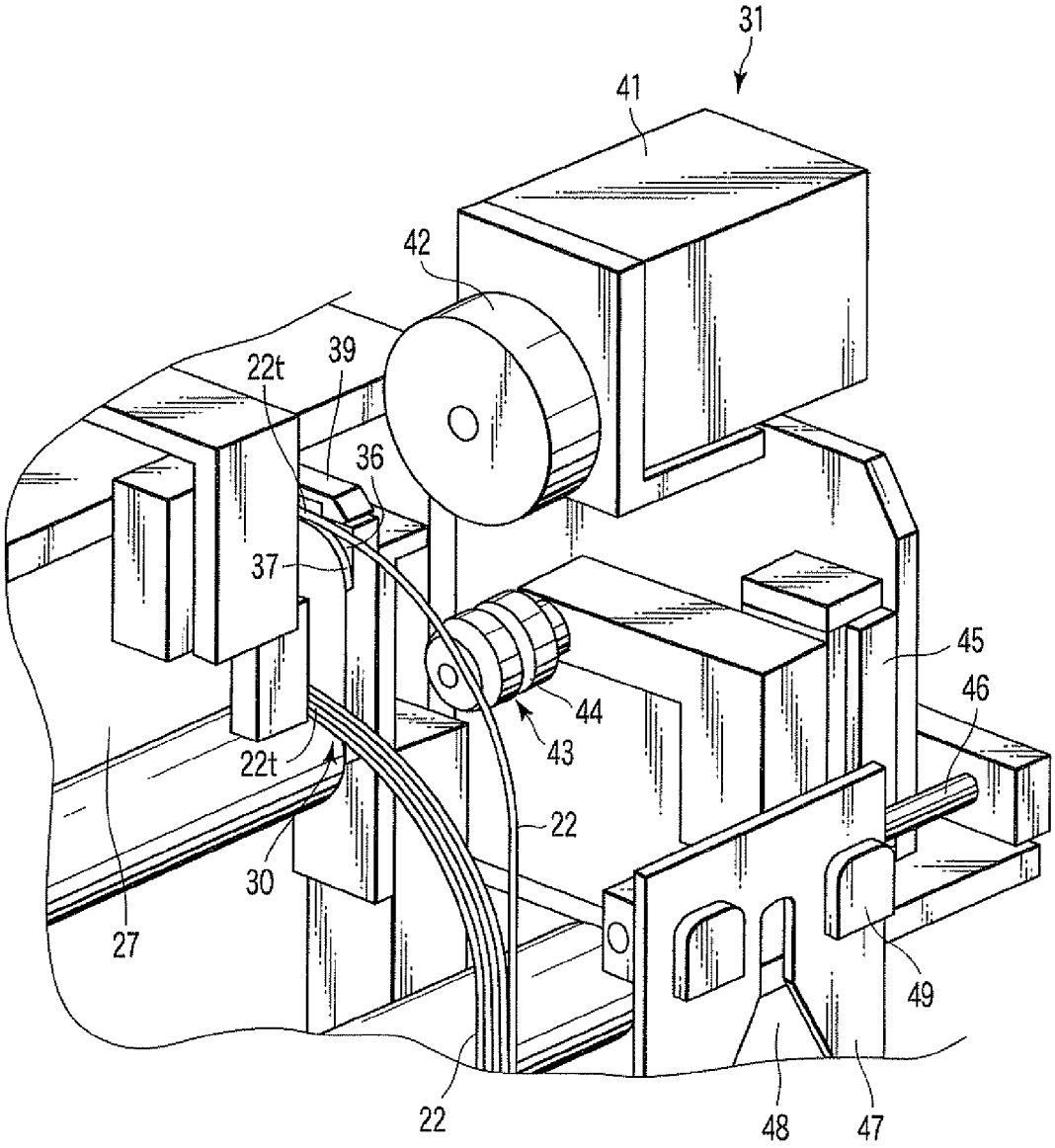
FIG. 9 is a perspective view showing an extraction step in one embodiment of the present invention.

Referring to FIG. 9, the extraction member 35 is moved upward by the extraction air cylinder 38. The abutment surface 37 forming the bottom face of the extraction groove 36 abut against the lower side of the coil top portion **22*t*, and the coil top portion 22*t* is moved upward due to the upward movement of the abutment surface 37. During the upward movement, the coil top portion 22***t* is held between the extraction member 35 and the row plate 27, and does not drop from the extraction groove 36. Further, the upward movement of the coil top portions 22*t* other than the coil top portion 22*t* contained in the extraction groove 36 is stopped by the row plate 27. If end portion side of the coil 22 contained in the extraction groove 36 are intertwined with the other coils 22, the coil top portion 22*t* is moved upward and the end portion side of the coil 22 is draw from the other coils 22, and so the intertwinement of the coils 22 are unraveled. Thus, the one coil top portion 22*t* is extracted from the plurality of coil top portions 22*t* arranged side by side.

During the steps described above, the clamp roller 43 and the feed roller 42 are disposed at the non-feed positions where they are being separated from the extraction unit 30, and the clamp roller 43 is disposed at the non-clamp position where it is being separated downward from the feed roller 42.

Figure 10:
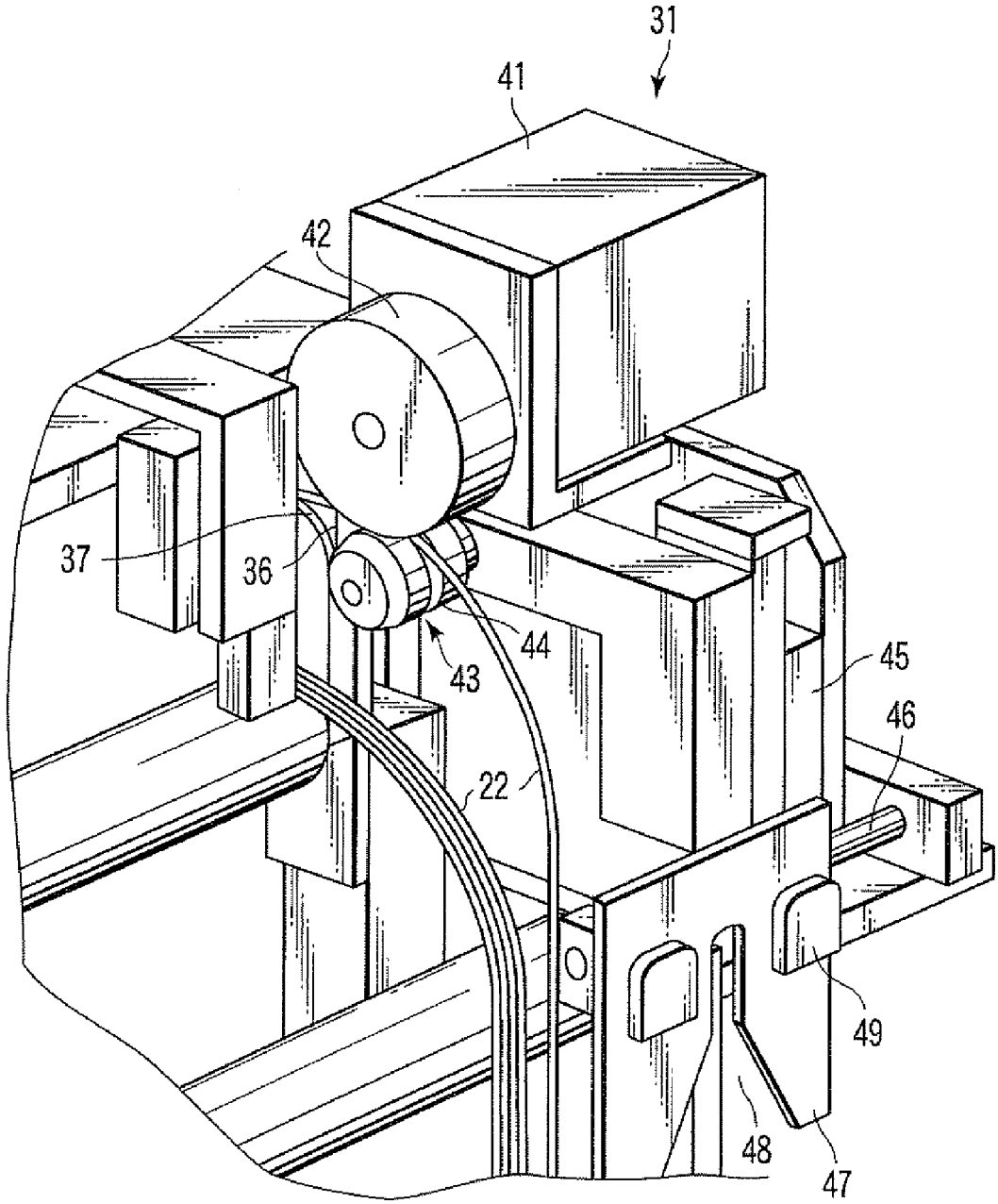
FIG. 10 is a perspective view showing an upstream direction feeding preparation step in one embodiment of the present invention.

Referring to FIG. 10, the clamp roller 43 and the feed roller 42 are disposed at the feed positions where they are being proximate to the extraction unit 30 by the horizontal movement air cylinder 46, and the coil 22 extending from the extraction groove 36 is disposed between the clamp roller 43 and the feed roller 42. Then, the clamp roller 43 is moved upward by the vertical movement air cylinder 45. Through the upward movement of the clamp roller 43, the coil 22 is contained in the clamp groove 44, and moved upward together with the clamp roller 43, and when the clamp roller 43 is disposed at a contact position where it is being contact with the feed roller 42, the coil 22 is clamped between the clamp roller 43 and the feed roller 42.

Figure 11:
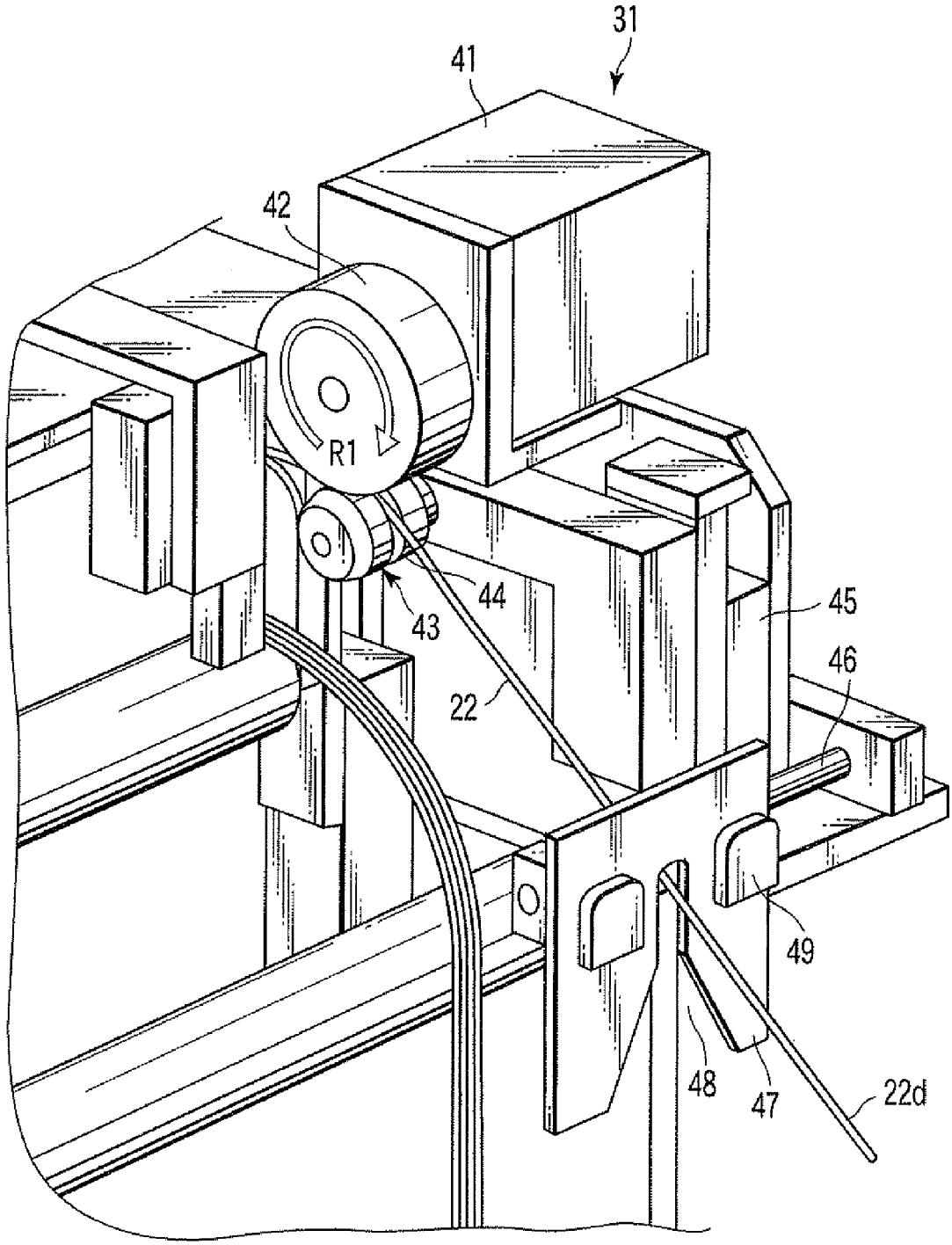
FIG. 11 is a perspective view showing an upstream direction feeding step and a downstream end portion detection step in one embodiment of the present invention.

Referring to FIG. 11, the feed roller 42 is rotated as indicated by an arrow R1, and so the coil 22 is drawn into the feed roller 42 and fed from the downstream side to the upstream side in the longitudinal direction of the coil 22. If the downstream end side portion 22*d* of the fed coil 22 is intertwined with the other coils 22, the intertwinement is unraveled by the feeding of the coil 22. As the coil 22 is being fed, the downstream end side portion 22*d* of the coil 22 is gradually lifted up by the elastically repulsive properties of the coil 22, and moved upward along the guide groove 48 of the guide plate 47, and thus fed in the guide groove 48. At the point where the downstream end portion 22*d* of the coil 22 has passed the guide groove 48, the second sensor 49 detects no coil 22 within the guide groove 48, and the position of the downstream end portion 22*d* of the coil 22 is detected. At this point, the rotation of the feed roller 42 is stopped.

Figure 12:
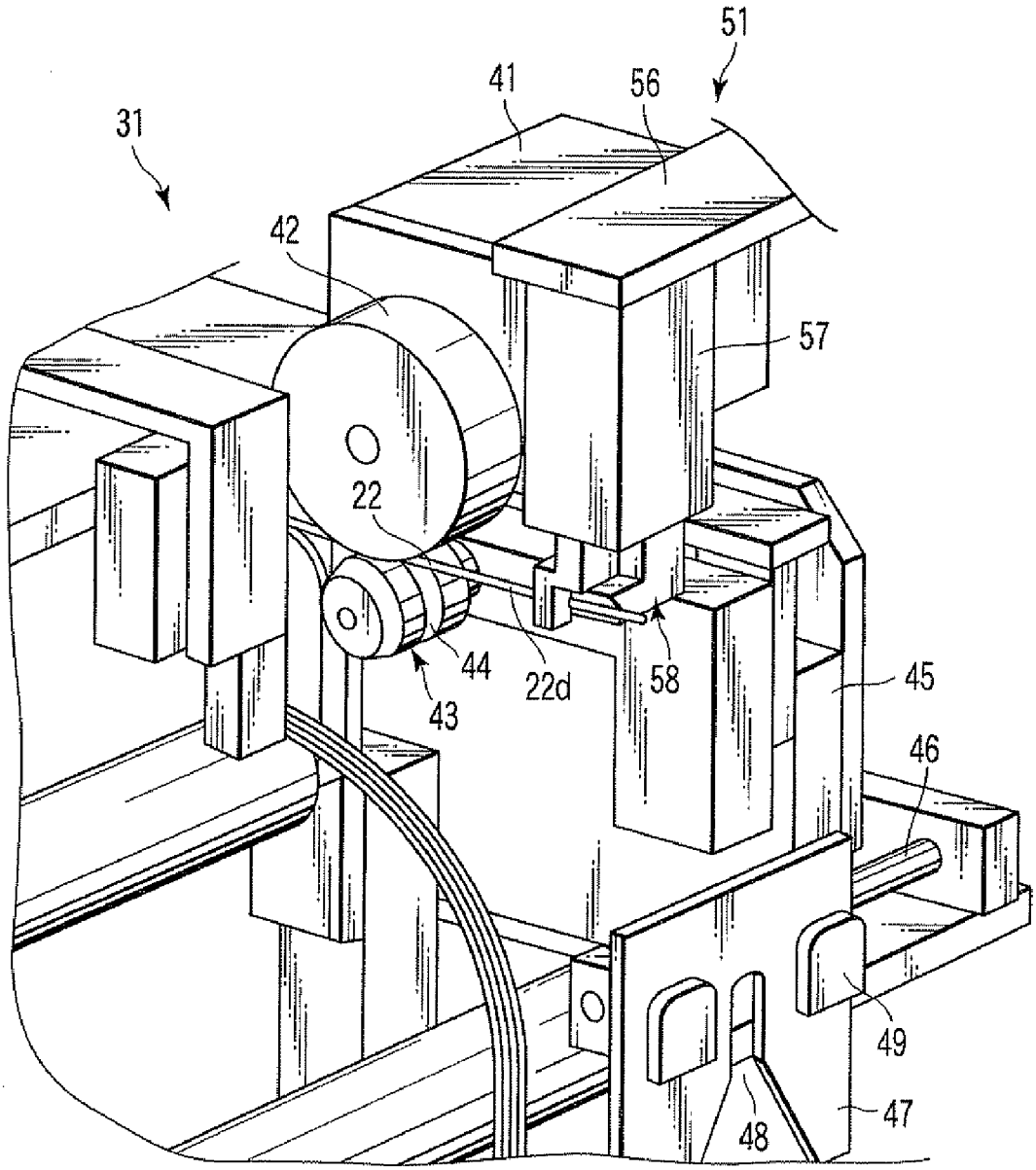
FIG. 12 is a perspective view showing a downstream end portion gripping step in one embodiment of the present invention.

Referring to FIG. 12, at the point where the feed roller 42 has been stopped, the downstream end portion 22*d* of the coil 22 is disposed in the vicinity of the downstream sides of the feed roller 42 and the clamp roller 43. In the handover unit 51, the chuck 58 is opened by the chuck air cylinder 57. The opened chuck 58 is disposed at the grip position by the handover unit 51. At this position, the chuck 58 is closed by the chuck air cylinder 57, and the downstream end portion 22*d* of the coil 22 is gripped by the chuck 58 such that a given clamp margin may remain at the end portion.

Figure 13:
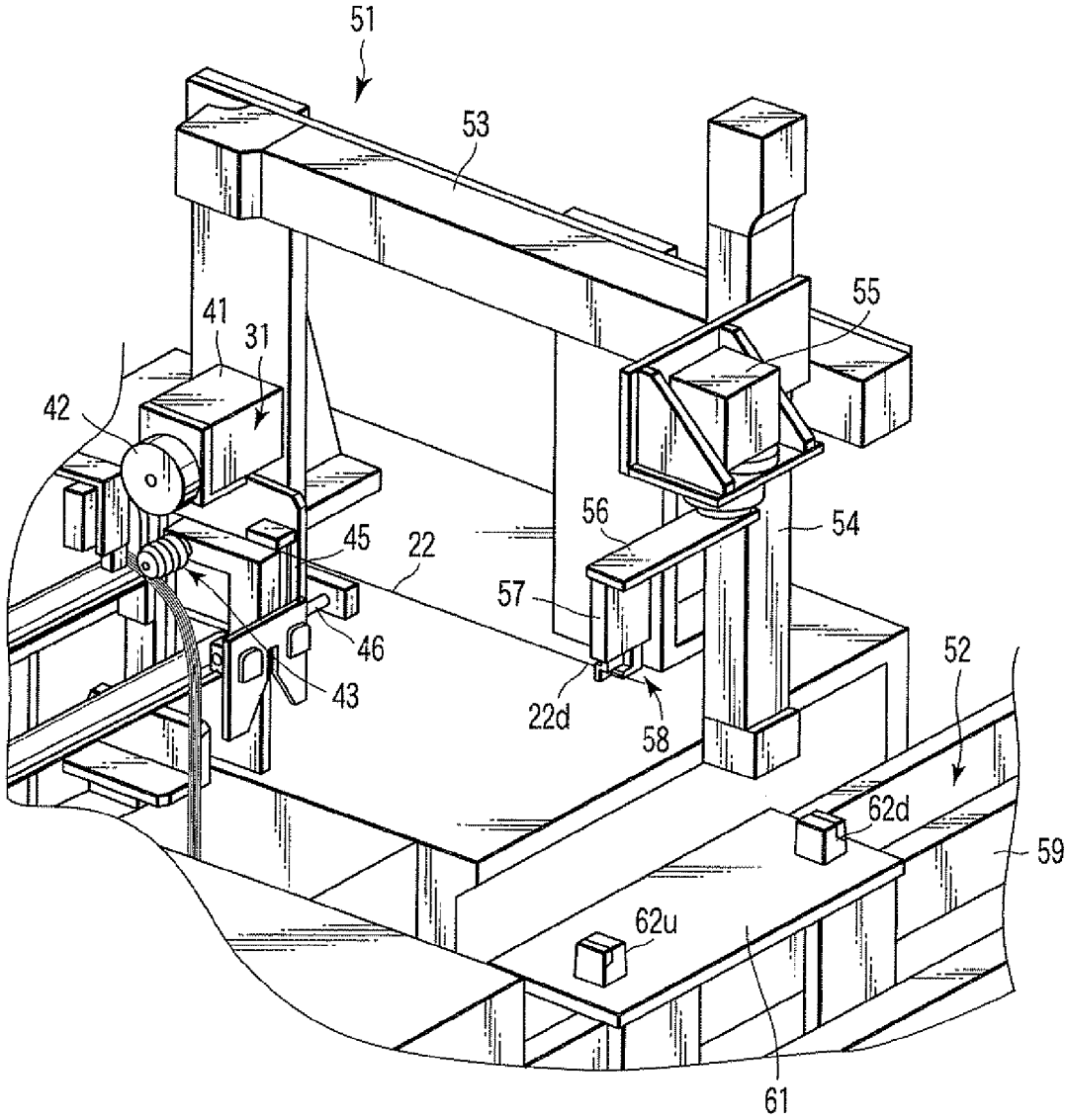
FIG. 13 is a perspective view showing the first half of a downstream end portion handover step in one embodiment of the present invention.

Referring to FIG. 13, the clamp roller 43 is moved downward by the vertical movement air cylinder 45, and so the clamp of the coil 22 by the clamp roller 43 and the feed roller 42 is released. Then, the chuck 58 is moved by the horizontal conveyance air cylinder 53 toward the horizontal downstream side up to a position above the pallet 61, and the downstream end portion 22*d* of the coil 22 is moved to a position above the pallet 61. The movement of the pallet 61 is stopped by the stopper, and the pallet 61 is positioned at the handover position by the positioning pin.

Figure 14:
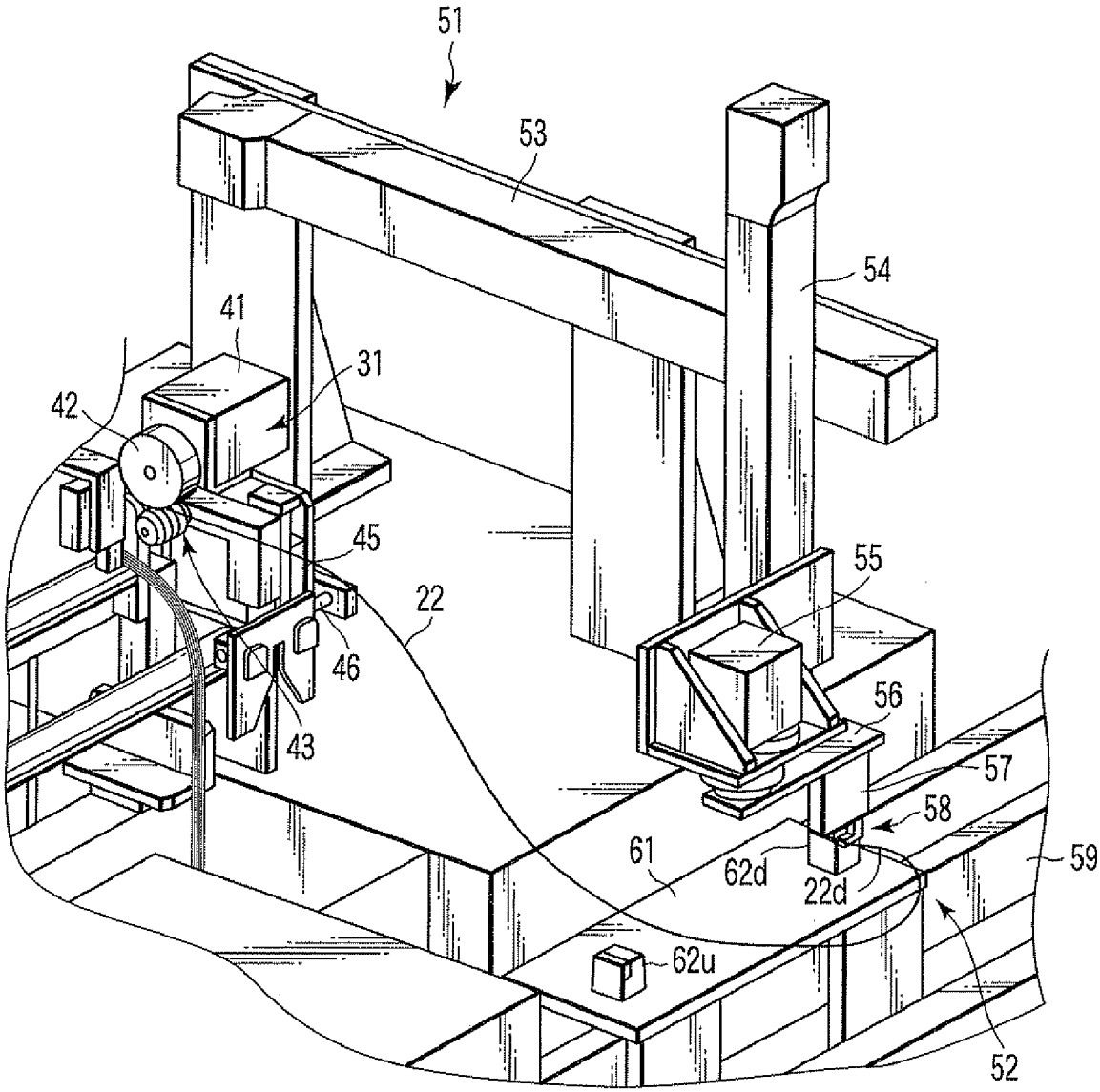
FIG. 14 is a perspective view showing the second half of the downstream end portion handover step in one embodiment of the present invention.

Referring to FIG. 14, the clamp roller 43 is moved upward by the vertical movement air cylinder 45, and so the coil 22 is clamped by the clamp roller 43 and the feed roller 42. Then, the chuck 58 is reversed by the reversing motor 55 while being moved downward by the vertical conveyance air cylinder 54, and is disposed at the downstream handover position in the vicinity of the downstream clamp 62*d*. During that, the coil 22 is fed out by the feed roller 42 in response to the movement of the downstream end portion 22*d* of the coil 22 by the handover unit 51, and excessive tension or unnecessary slackness is prevented from being produced in the coil 22. Here, the downstream clamp 62*d* is being opened by the downstream clamp air cylinder, and the downstream end portion 22*d* of the coil 22 is disposed in the downstream clamp 62*d*. Then, the downstream clamp 62*d* is closed by the downstream clamp air cylinder, and the downstream end portion 22*d* of the coil 22 is thus gripped. Further, the chuck 58 is opened by the chuck air cylinder 57, and thus the grip of the downstream end portion 22*d* of the coil 22 by the chuck 58 is released.

Figure 15:
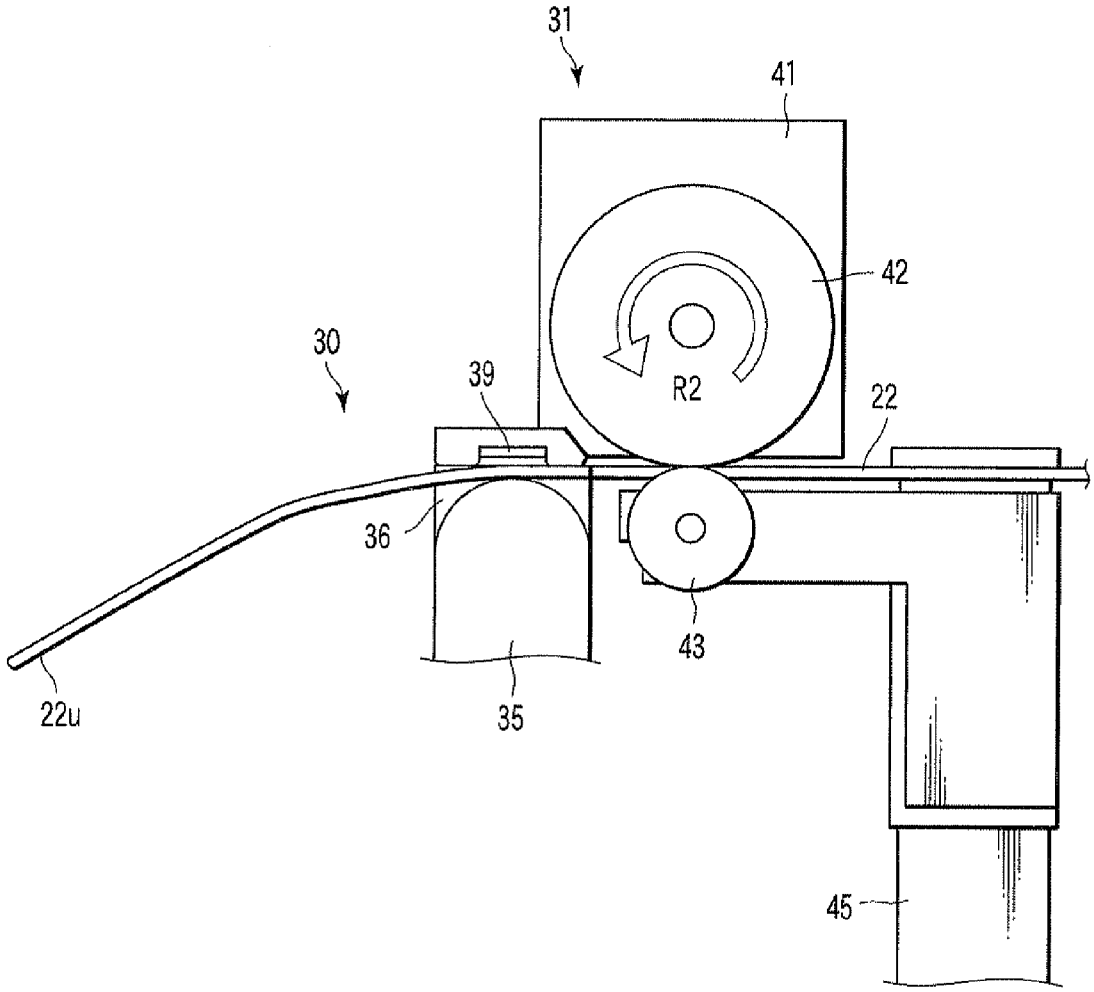
FIG. 15 is a side view showing a downstream direction feeding step in one embodiment of the present invention.

Referring to FIG. 15, the coil 22 is being clamped by the feed roller 42 and the clamp roller 43. As indicated by an arrow R2, the feed roller 42 is rotated, and the coil 22 is fed along its longitudinal direction from the upstream side to the downstream side and drawn out of the extraction groove 36. During that, if the upstream end portion 22*u* side of the coil 22 to be fed is intertwined with the other coils 22, the intertwinement is unraveled by the feeding of the coil 22.

Figure 16:
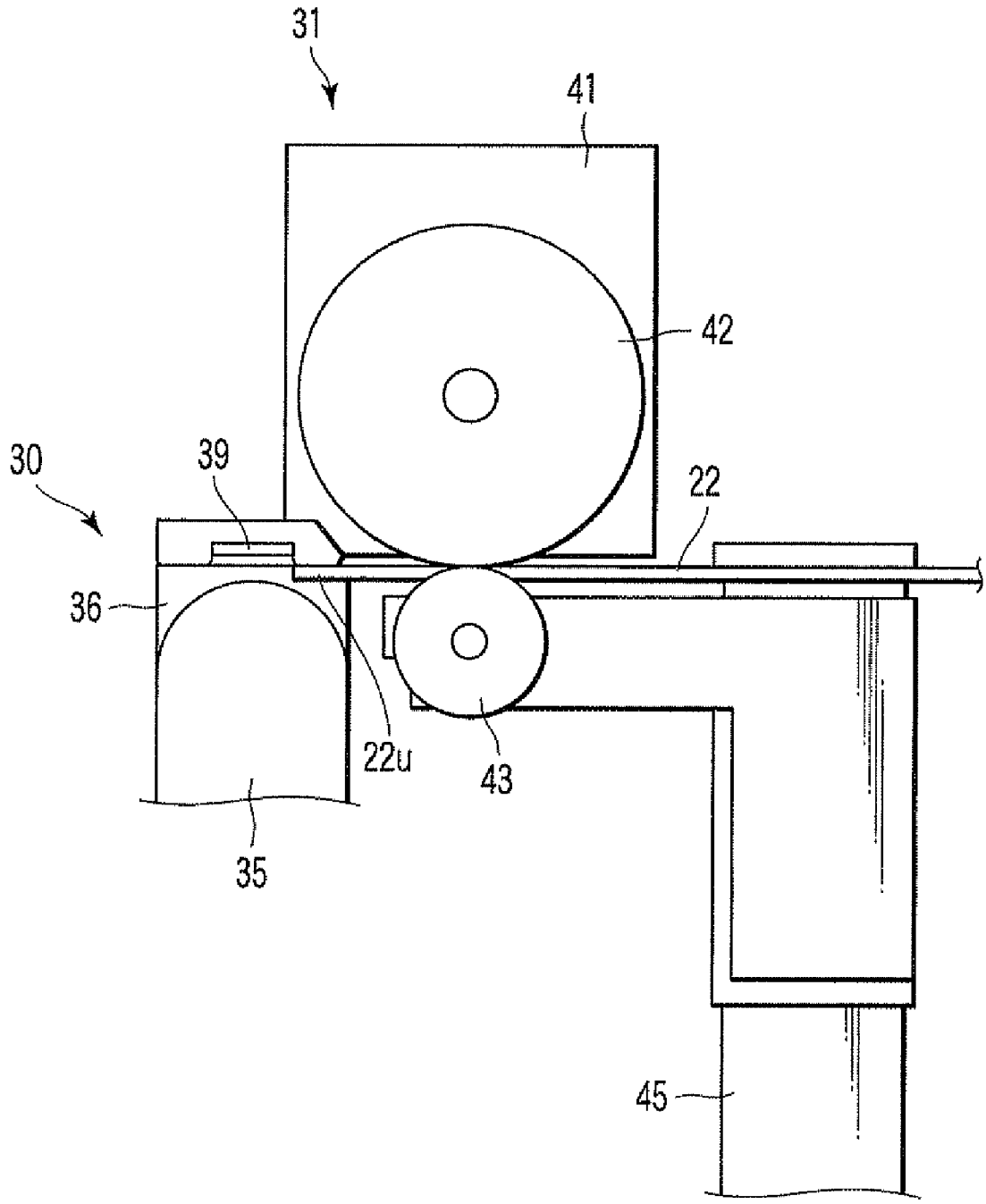
FIG. 16 is a side view showing an upstream end portion detection step in one embodiment of the present invention.

Referring to FIG. 16, when the upstream end portion 22*u* of the coil 22 is drawn out of the extraction groove 36, the first sensor 39 detects that the coil 22 is not present in the extraction groove 36, and the upstream end portion 22*u* of the fed coil 22 is detected. At this point, the rotation of the feed roller 42 is stopped, and the feeding of the coil 22 is thus stopped. After the coil 22 has been removed from the extraction groove 36, the extraction member 35 is properly moved downward by the extraction air cylinder 38 and disposed at the storage position.

Figure 17:
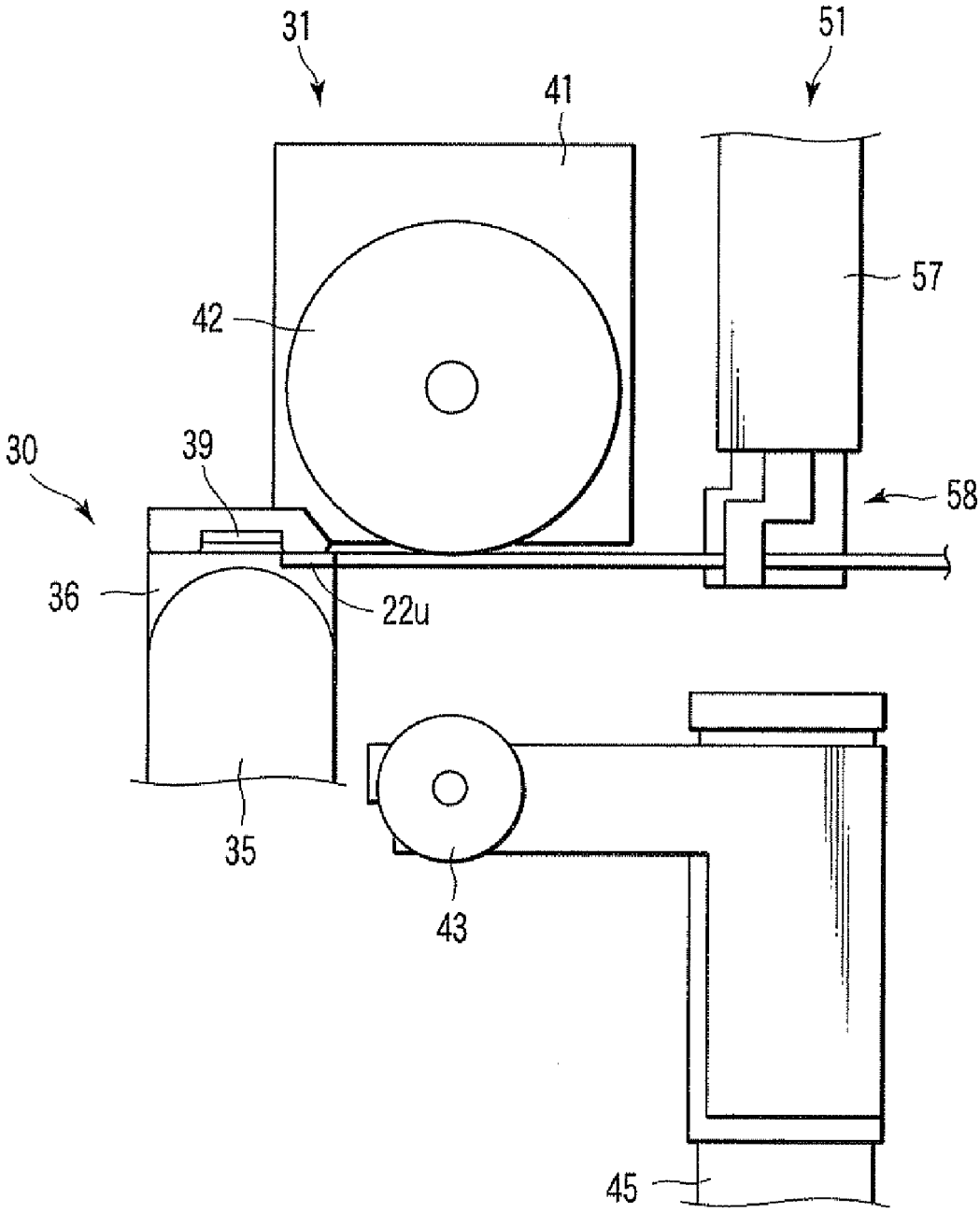
FIG. 17 is a side view showing an upstream end portion gripping step in one embodiment of the present invention.

Referring to FIG. 17, the chuck 58 is moved by the handover unit 51 to the grip position in the vicinity of the downstream sides of the feed roller 42 and the clamp roller 43. The chuck 58 is closed by the chuck air cylinder 57, and the upstream end portion 22*u* of the coil 22 is gripped by the chuck 58 such that a given clamp margin may remain at the end portion. Then, the clamp roller 43 is moved downward by the vertical movement air cylinder 45, and the clamp of the coil 22 by the feed roller 42 and the clamp roller 43 is released. After that, the feed roller 42 and the clamp roller 43 are properly horizontally moved by the horizontal movement air cylinder 46, and thus disposed at the non-feed positions where they are being separated from the extraction unit 30.

Figure 18:
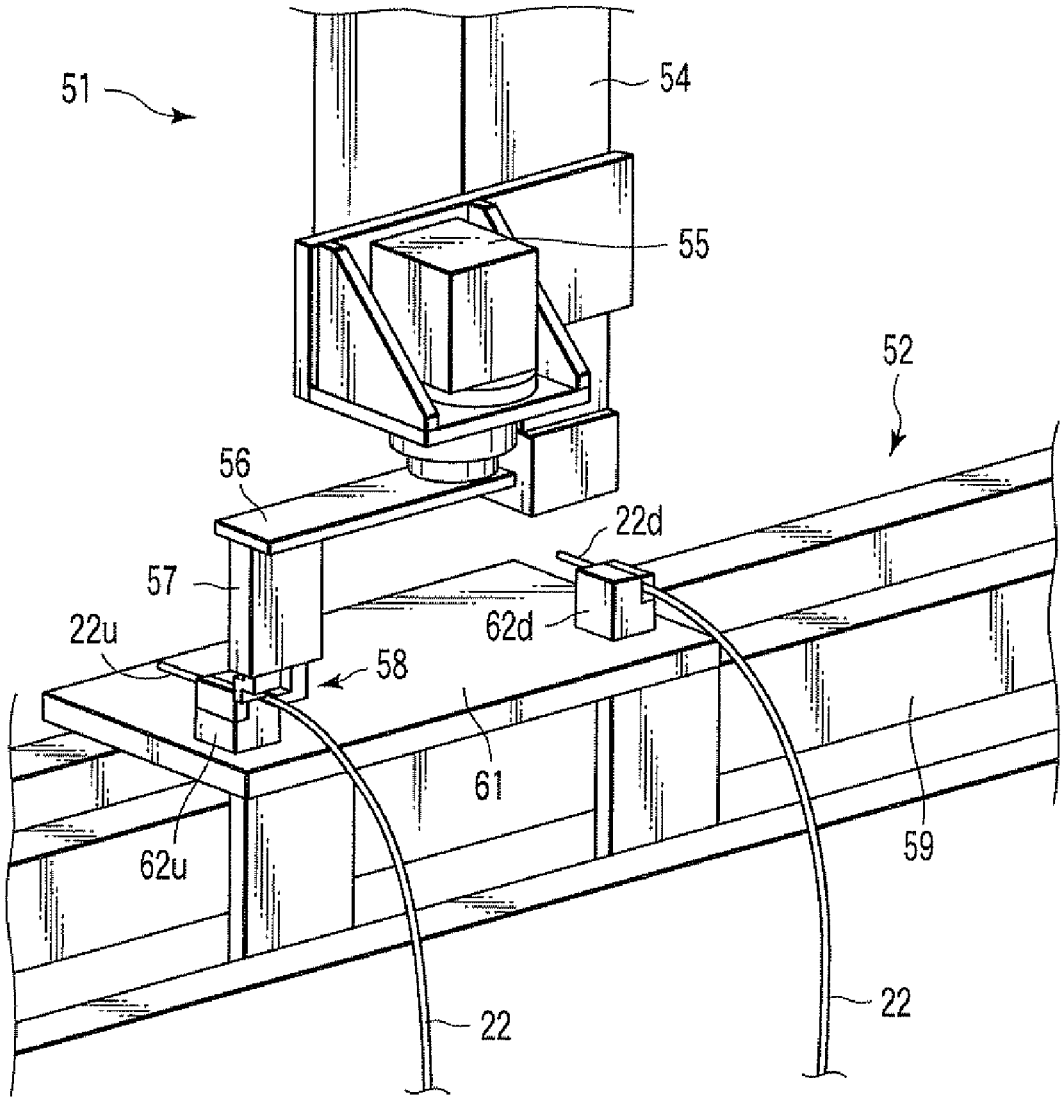
FIG. 18 is a perspective view showing an upstream end portion handover step in one embodiment of the present invention.

Referring to FIG. 18, the chuck 58 is moved to the position above the pallet 61 by the horizontal conveyance air cylinder 53, and then moved downward by the vertical conveyance air cylinder 54 and disposed at the upstream handover position in the vicinity of the upstream clamp 62*u*. Here, the upstream clamp 62*u* is being opened by the upstream clamp air cylinder, and the upstream end portion 22*u* of the coil 22 is disposed in the upstream clamp 62*u*. Then, the upstream clamp 62*u* is closed by the upstream clamp air cylinder, and the upstream end portion 22*u* of the coil 22 is thus gripped. Further, the chuck 58 is opened by the chuck air cylinder 57, and the grip of the upstream end portion 22*u* of the coil 22 by the chuck 58 is thus released. Then, the chuck 58 is moved upward by the vertical conveyance air cylinder 54, and separated from the pallet 61. After that, the chuck 58 is properly moved to an appropriate position by the horizontal conveyance air cylinder 53 and the vertical conveyance air cylinder 54, and put on standby.

Figure 19:
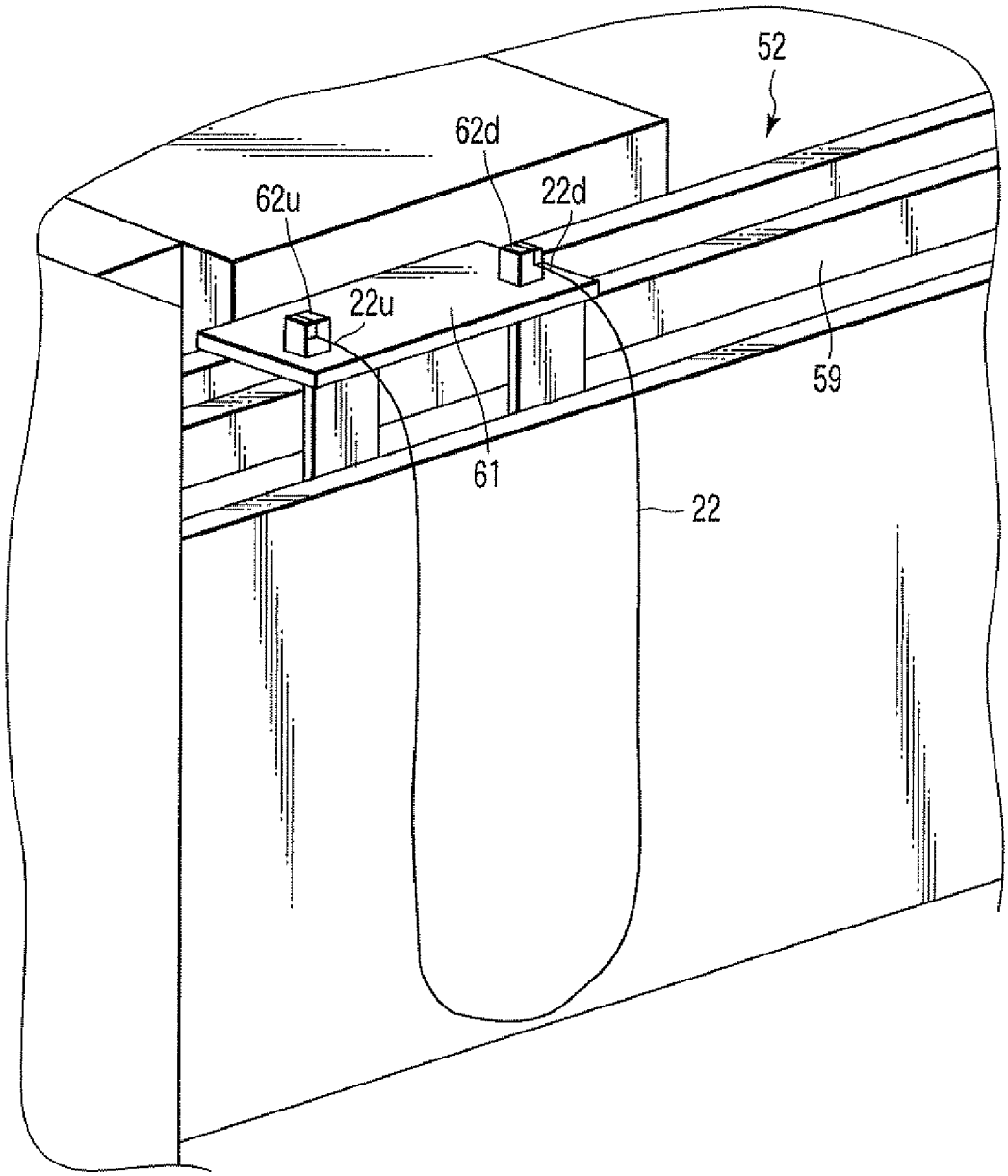
FIG. 19 is a perspective view showing a conveyance step in one embodiment of the present invention.
Figure 20A:
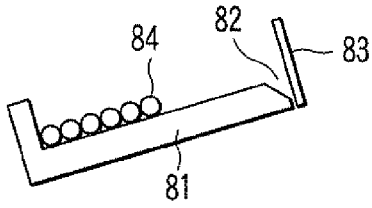
RELATED ART FIG. 20A
FIG. 20A is a sectional view showing a stock step of a rod member supply method in a related art.
Figure 20B:
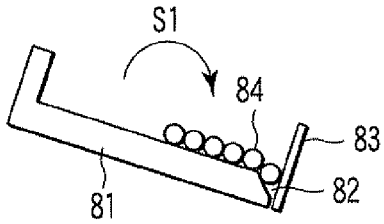
RELATED ART FIG. 20B
FIG. 20B is a sectional view showing a guide step of the rod member supply method in the related art.
Figure 20C:
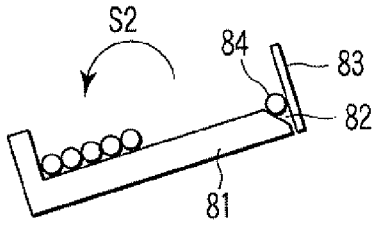
RELATED ART FIG. 20C
FIG. 20C is a sectional view showing a separation step of the rod member supply method in the related art.
Figure 20D:
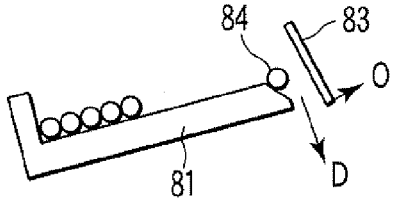
RELATED ART FIG. 20D
FIG. 20D is a sectional view showing an extraction step of the rod member supply method in the related art.

Referring to FIG. 19, both end portions of the coil 22 are disposed in the same one direction of the width directions of the conveyer 59, and the coil 22 is hanged in a U shape beside the conveyer 59. The positioning pin and the stopper are actuated by the positioning air cylinder and the stopper air cylinder, and the positioning of the pallet 61 and the stop of the movement thereof are released. Then, the pallet 61 is conveyed to the following step by the conveyer 59.

Thus, the feeding of the coil 22 is completed.

In the same manner, the steps shown in FIGS. 7 to 19 are repeated, and the plurality of coils 22 are extracted one by one and fed, until there is no coil 22 stocked in the stock unit 23. When there is no stocked coil 22, a plurality of coils 22 are again put in the stock unit 23. In the same manner, the extraction and feeding of the coil 22 are carried out.

Therefore, the coil supply apparatus and the coil supply method of the present embodiment provide the following effects.

In the coil supply apparatus and the coil supply method of the present embodiment, the plurality of coils 22 are stocked such that the coils 22 are suspended in the inverted U shape and the coil top portions 22*t* is arranged side by side, and the coil top portions 22*t* are operated to extract one coil 22 from the plurality of coils 22. This makes it possible to extract the coil 22 in a reliable manner. Thus, the coil supply apparatus and the coil supply method of the present embodiment are suitable for the extraction of the coil 22.

Furthermore, the coil top portions 22*t* are arranged side by side in the row space 28 between the suspension bar 24*a* and the row plate 27 and the width of the row space 28 is substantially equal to the outside diameter of the coil 22. Thus, the coil top portions 22*t* can be readily and reliably arranged side by side.

Still further, the plurality of coil top portions 22*t* arranged side by side is moved and so the one coil top portion 22*t* is guided to and stored in the extraction groove 36, and the abutment surface 37 is abutted against the lower side of one coil top portion 22*t* and moved upward and so the one coil top portion 22*t* is moved upward, while the upward movement of the other coil top portions 22*t* is stopped. This makes it possible to extract the coil top portion 22*t* in a highly reliable manner.

In addition, the coil 22 including the extracted coil top portion 22*t* is fed in its longitudinal direction and thus separated from the other coils 22. This makes it possible to extract the coil 22 in a highly reliable manner.

Various drive mechanisms can be used instead of the air cylinders and the reversing motor in the embodiment described above. For example, feed screw mechanisms can be used instead of the extrusion air cylinder and the extraction air cylinder. Moreover, an air-driven rotary actuator can be used instead of the reversing motor.

While the coil supply apparatus and the coil supply method for supplying coils have been described in the embodiment, the present invention is applicable to various elongate supply target member having elasticity and including both end portions. For example, the present invention is applicable to a apparatus and method for supplying a wire or a tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An automatic supply apparatus for an elongate supply target member having elasticity and including both end portions, the apparatus comprising:

a stock mechanism wherein a plurality of supply target members are to be stocked such that the plurality of supply target members are suspended in an inverted U shape and top portions of the plurality of supply target members are arranged side by side in a row direction; and an extraction mechanism configured to operate the top portions of the supply target members to extract one supply target member from the plurality of supply target members stocked in the stock mechanism;

wherein the extraction mechanism includes a guide unit and an extraction unit, the guide unit is configured to move the plurality of top portions arranged side by side in the row direction to guide one top portion to the extraction unit, and the extraction unit includes: a storage portion configured to store the one top portion alone; an abutment portion configured to abut against a lower side of the one top portion stored in the storage portion and configured to be moved upward; and a stopper portion configured to stop an upward movement of top portions other than the one top portion stored in the storage portion and against which the storage portion abuts.

2. The automatic supply apparatus according to claim 1, wherein the stock mechanism includes:

a suspension portion extending in the row direction and on which the plurality of supply target members are to be suspended in the inverted U shape; and a row portion arranged side by side with the suspension portion and forming a row space having a width substantially equal to the outside diameter of the supply target member, between the suspension portion and the row portion.

3. An automatic supply method for an elongate supply target member having elasticity and including both end portions, the method comprising:

stocking a plurality of supply target members by suspending the plurality of supply target members in an inverted U shape and arranging top portions of the plurality of supply target members side by side in a row direction; and extracting one supply target member from the plurality of stocked supply target members by operating the top portions of the supply target members;

wherein the extracting includes moving the top portions arranged side by side in the row direction to guide one top portion to extraction; storing the one top portion alone in a storage portion; abutting an abutment portion against a lower side of the stored one top portion and stopping an upward movement of top portions other than the stored one top portion and against which the storage portion abuts.

4. The automatic supply apparatus according to claim 1, wherein the extraction mechanism further includes a feed unit configured to feed one supply target member including the top portion extracted by the extraction unit in a longitudinal direction of the one supply target member to separate the one supply target member from the other supply target member.

* * * * *